US011384985B2

(12) United States Patent
Carner et al.

(10) Patent No.: US 11,384,985 B2
(45) Date of Patent: Jul. 12, 2022

(54) FURNACE STAVE

(71) Applicant: Berry Metal Company, Harmony, PA (US)

(72) Inventors: Brayton Carner, Harmony, PA (US); Jacob White, Harmony, PA (US)

(73) Assignee: Berry Metal Company, Harmony, PA (US)

( * ) Notice: Subject to any disclaimer, the term of this patent is extended or adjusted under 35 U.S.C. 154(b) by 84 days.

(21) Appl. No.: 15/597,887

(22) Filed: May 17, 2017

(65) Prior Publication Data

US 2017/0336144 A1 Nov. 23, 2017

Related U.S. Application Data

(60) Provisional application No. 62/337,448, filed on May 17, 2016.

(51) Int. Cl.

| | |
|---|---|
| ***F27D 1/12*** | (2006.01) |
| ***F27D 1/00*** | (2006.01) |
| ***F27D 1/14*** | (2006.01) |
| ***F27D 1/16*** | (2006.01) |
| ***F27B 3/14*** | (2006.01) |
| ***F27B 3/24*** | (2006.01) |
| ***F23M 5/02*** | (2006.01) |
| ***F23M 5/08*** | (2006.01) |

(52) U.S. Cl.

CPC ..... *F27D 1/12* (2013.01); *F23M 5/02* (2013.01); *F23M 5/08* (2013.01); *F27B 3/14* (2013.01); *F27B 3/24* (2013.01); *F27D 1/00* (2013.01); *F27D 1/004* (2013.01); *F27D 1/0006* (2013.01); *F27D 1/147* (2013.01); *F27D 1/1621* (2013.01)

(58) Field of Classification Search

CPC .... F23M 5/02; F23M 5/08; F27B 3/14; F27B 3/24; F27D 1/00; F27D 1/0006; F27D 1/004; F27D 1/12; F27D 1/147; F27D 1/1621

USPC ..... 266/46, 190, 193, 194, 241, 99, 280, 78, 266/286; 29/428; 432/83

See application file for complete search history.

(56) References Cited

U.S. PATENT DOCUMENTS

| | | | | |
|---|---|---|---|---|
| 3,953,008 A * | 4/1976 | Bashinsky | C21B 7/10 266/193 |
| 3,984,089 A | 10/1976 | Van Laar et al. | |
| 4,669,708 A * | 6/1987 | Rollot | C21B 7/10 266/193 |
| 5,251,882 A * | 10/1993 | Kammerling | C21B 7/10 122/6 B |

(Continued)

FOREIGN PATENT DOCUMENTS

| | | |
|---|---|---|
| EP | 0411336 | 2/1991 |

OTHER PUBLICATIONS

Form PCT/IB/326, PCT Notification Concerning Transmittal of International Preliminary Reporton Patentability, PCT/US2017/033125, dated Nov. 29, 2018.

*Primary Examiner* — Jessee R Roe
*Assistant Examiner* — Michael Aboagye
(74) *Attorney, Agent, or Firm* — Clark Hill PLC

(57) ABSTRACT

A furnace stave comprising a plurality of internal channels or conduits for circulating cooling fluid through the stave; an inlet and an outlet channel associated with each internal channel or conduit; wherein one of the internal channels or conduits is disposed in a protrusion from the stave.

7 Claims, 12 Drawing Sheets

(56) References Cited

U.S. PATENT DOCUMENTS

| | | | | |
|---|---|---|---|---|
| 5,295,666 | A * | 3/1994 | Rollot | C21B 7/10 266/193 |
| 10,247,477 | B2 * | 4/2019 | Smith | C21B 7/106 |
| 2012/0104670 | A1 * | 5/2012 | Smith | F23M 5/02 266/280 |
| 2013/0008636 | A1 | 1/2013 | Smith | |
| 2016/0161185 | A1 * | 6/2016 | Smith | F27D 1/12 266/193 |

* cited by examiner

Hot Face

Coil Layout

Hot Face

Coil Layout

FURNACE STAVE

CROSS REFERENCE TO RELATED APPLICATIONS

This application claims the benefit of provisional patent application U.S. Ser. No. 62/337,448 filed May 17, 2016, which is incorporated by reference herein for all purposes.

TECHNICAL FIELD OF THE INVENTION

The present disclosure generally relates to the field of cooling equipment for metallurgical furnaces such as blast furnaces. More precisely, the present disclosure concerns a furnace stave cooler system and method. Related fields include systems and methods for cooling blast furnaces and other metallurgical furnaces. Related fields include cooling plates and cooling staves.

BACKGROUND—FIELD OF THE DISCLOSURE

Conventional designs and constructions for cooling refractory bricks in blast furnaces and other metallurgical furnaces include cooling staves. Conventional copper cooling staves are generally planar, rectangularly shaped and arranged within a furnace substantially parallel or as parallel as possible, given the shapes of the staves and/or the interior of the furnace, to the metal shell of the furnace. The cooling staves typically cover a high percentage of the inner surface of the metal shell of the furnace. Refractory lining, such as refractory bricks, may be disposed in, on or around the surface of the stave, such as, for example, bricks disposed within slots or channels defined by the stave. Staves also have cavities that provide passages or house internal piping. Such passages or piping are connected to one or more external pipes that extend from the furnace shell side of the stave and penetrate the metal shell of the furnace. Coolant, such as, for example, water at an elevated pressure is pumped through the pipes and passages in order to cool the stave. The cooled stave thus cools the refractory bricks disposed within slots or channels defined by the stave.

Current stave or cooling panel brick designs typically are not efficient at controlling the temperature across the face of the refractory bricks or at protecting such refractory bricks from damage from heat and/or falling debris within a furnace.

Accordingly, it would be desirable to provide a stave/brick construction in which the refractory bricks are protected at the top, bottom and any level in between by a fluid-cooled nose or protrusions of the stave that may or may not have its own cooling fluid circuit.

In addition, it would be desirable to provide a stave/brick construction which provides additional features such as a staggered brick face producing a variable thermal profile to promote slag accretions across the stave and face of the refractory bricks to protect the stave/brick construction.

These and other advantages of the disclosure will be appreciated by reference to the detailed description of the preferred embodiment(s) that follow.

BRIEF SUMMARY OF THE INVENTION

Many other variations are possible with the present disclosure, and those and other teachings, variations, and advantages of the present disclosure will become apparent from the description and figures of the disclosure.

One aspect of a preferred embodiment of the present disclosure comprises a furnace stave comprising a plurality of internal channels or conduits for circulating cooling fluid through the stave; an inlet and an outlet channel associated with each internal channel or conduit; wherein one of the internal channels or conduits is disposed in a protrusion from the stave.

In another aspect of a preferred stave of the present disclosure, the protrusion is located at the top, bottom and/or a location in between the top and bottom of the stave.

In yet another aspect of a preferred stave of the present disclosure, the internal channel or conduit disposed in the protrusion is design to cool such protrusion to the extent necessary to form a gummy slag accretion on a surface of the nose or protrusion and not to over cool the same such that the accretion is brittle and susceptible to breaking off of the nose or protrusion.

In another aspect, a preferred stave of the present disclosure further comprises a plurality of protrusions, wherein each protrusion has its own internal cooling conduit or circuit.

In another aspect, a preferred stave of the present disclosure further comprises refractory bricks of at least two different thicknesses disposed within the stave to define a front face comprising one or more depressions.

Another aspect of a preferred embodiment of the present disclosure comprises a stave/brick construction, comprising: a stave having a plurality of ribs and a plurality of channels, wherein a front face of the stave defines a first opening into each of the channels disposed between consecutive ones of the plurality of ribs; a plurality of internal channels or conduits for circulating cooling fluid through the stave; an inlet and an outlet channel associated with each internal channel or conduit; wherein one of the internal channels or conduits is disposed in a protrusion of the stave face; wherein the protrusion extends beyond each of the plurality of ribs; and a plurality of bricks wherein each brick is insertable into one of the plurality of channels via its first opening to a position, upon rotation of the brick, partially disposed in the one channel such that one or more portions of the brick at least partially engage one or more surfaces of the one channel and/or of a first rib of the plurality of ribs whereby the brick is locked against removal from the one channel through its first opening via linear movement without first being rotated.

In another aspect of a preferred stave/brick construction of the present disclosure, the protrusion is located at the top, bottom and/or a location in between the top and bottom of the stave.

In yet another aspect of a preferred stave/brick construction of the present disclosure, the internal channel or conduit disposed in the protrusion is design to cool such protrusion to the extent necessary to form a gummy slag accretion on a surface of the nose or protrusion and not to over cool the same such that the accretion is brittle and susceptible to breaking off of the nose or protrusion.

In another aspect, a preferred stave/brick construction of the present disclosure further comprises plurality of protrusions, wherein each protrusion has its own internal cooling conduit or circuit.

In yet a further aspect, a preferred stave/brick construction of the present disclosure further comprises bricks of at least two different thicknesses disposed within the stave to define a front face comprising one or more depressions.

BRIEF DESCRIPTION OF THE SEVERAL VIEWS OF THE DRAWINGS

For the present disclosure to be easily understood and readily practiced, the present disclosure will now be described for purposes of illustration and not limitation in connection with the following figures, wherein.

DETAILED DESCRIPTION

In the following detailed description, reference is made to the accompanying examples and figures that form a part hereof, and in which is shown, by way of illustration, specific embodiments in which the inventive subject matter may be practiced. These embodiments are described in sufficient detail to enable those skilled in the art to practice them, and it is to be understood that other embodiments may be utilized and that structural or logical changes may be made without departing from the scope of the inventive subject matter. Such embodiments of the inventive subject matter may be referred to, individually and/or collectively, herein by the term "disclosure" merely for convenience and without intending to voluntarily limit the scope of this application to any single disclosure or inventive concept if more than one is in fact disclosed.

The following description is, therefore, not to be taken in a limited sense, and the scope of the inventive subject matter is defined by the appended claims and their equivalents.

Figure 1:
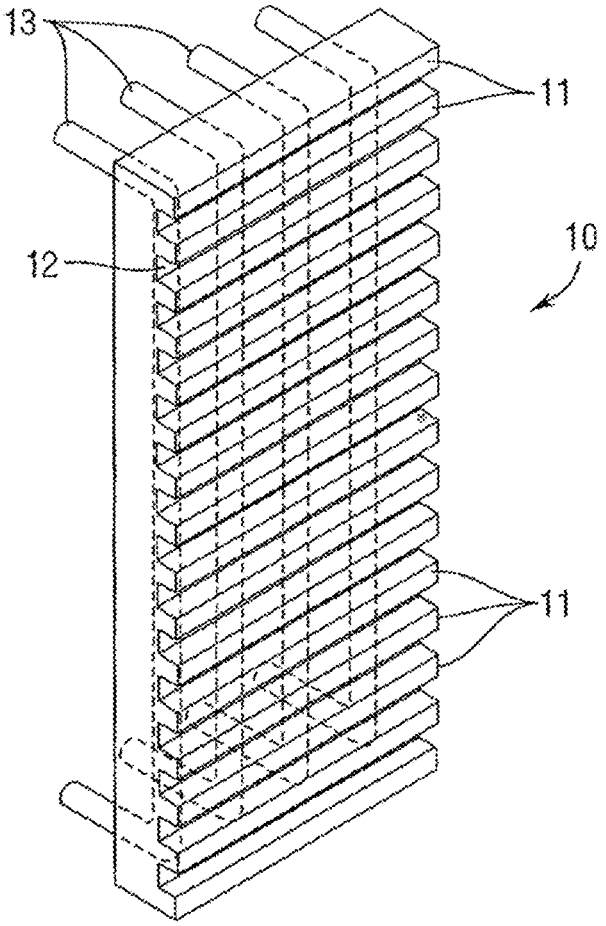
FIG. 1 (PRIOR ART)
FIG. 1 is a front perspective view of a conventional stave.

FIG. 1 illustrates a planar, fluid cooled stave 10 of known construction having a plurality of stave ribs 11 and defining a plurality of stave channels 12, both of generally rectangular cross-sections for use with bricks having matching cross-sections. Other stave designs of known construction (not shown) employ stave ribs and stave channels having cross-sections complementary to the dovetail sections of conventional refractory brick (not shown) to allow such dovetailed sections thereof to be inserted into the side ends of the stave and slid into position therein with or without mortar in between each adjacent brick. A major disadvantage of such known stave/brick constructions is that due to the closeness to each other when installed in a furnace, such staves 10 must be removed from the furnace to allow the bricks 14 to be slid out of the stave channels 12 whenever the stave/brick construction needs to be rebuilt or repaired, either in-whole or in-part. Removing such staves 10 from the furnace is necessitated because such bricks cannot be removed or inserted into stave channels 12 through the front face of stave 10. As shown in FIG. 1, stave 10 comprises a plurality of pipes 13 disposed inside the stave 10 which may be connected to one or more external pipes that extend from the furnace shell side of the stave 10 and penetrate the metal shell of the furnace so that coolant, such as, for example, water at an elevated pressure is pumped through the pipes 13 in order to cool the stave 10 and any refractory bricks disposed within stave channels 12 when assembled and installed in a furnace.

Figure 2:
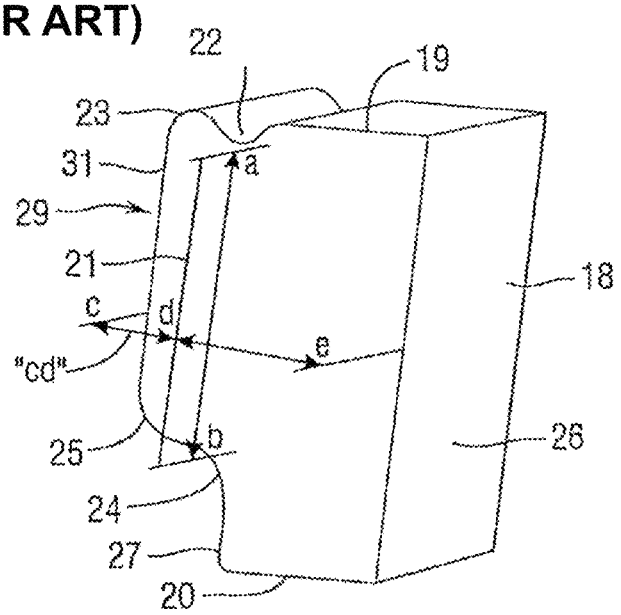
FIG. 2 is a side perspective view of a brick for use with a preferred embodiment of the present disclosure.
Figure 3:
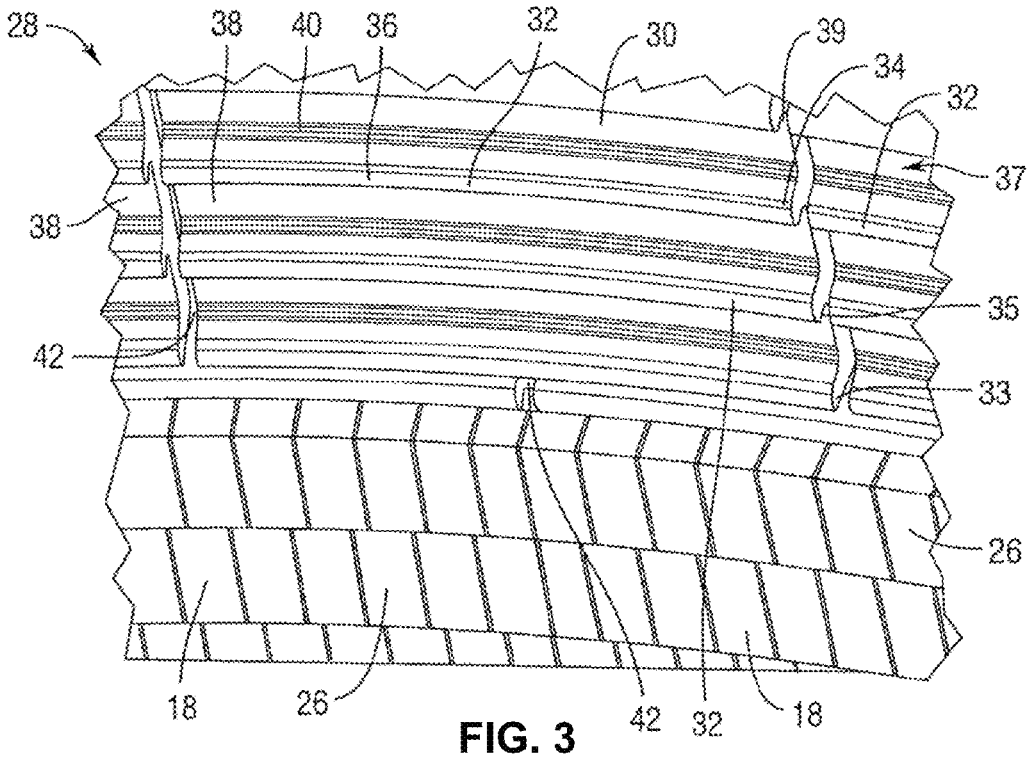
FIG. 3 is a top perspective view of a preferred embodiment of a stave/brick construction for modification according to the present disclosure.
Figure 4:
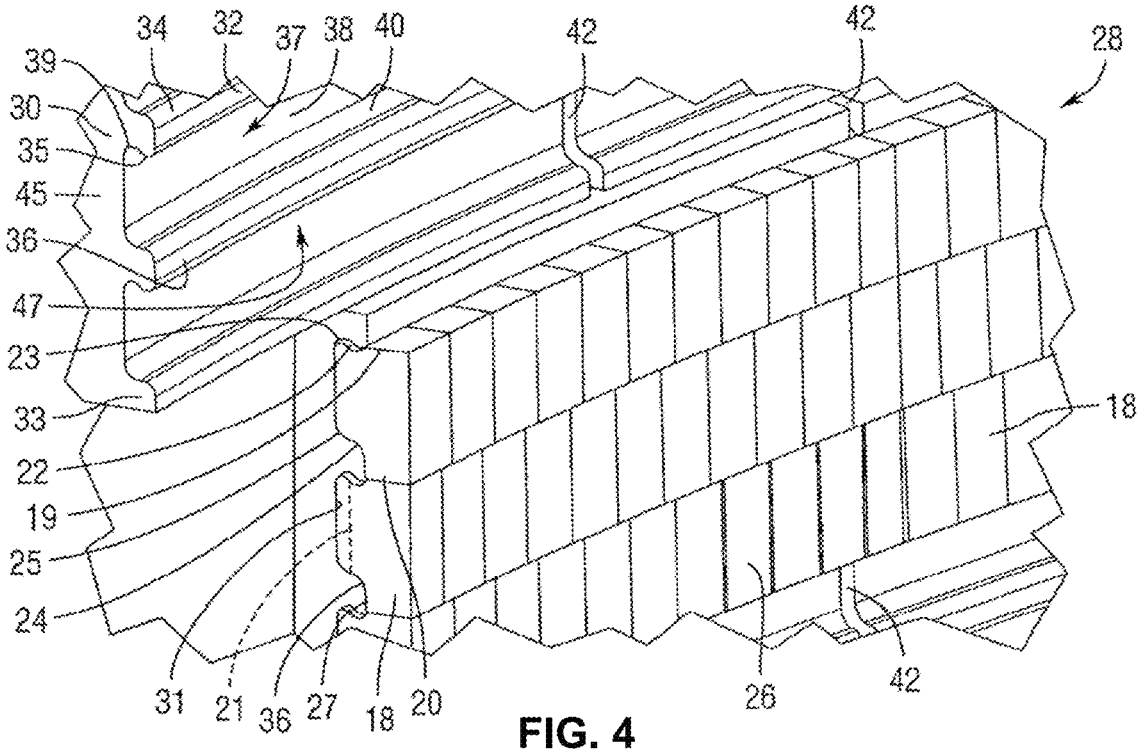
FIG. 4 is a side perspective view of a preferred embodiment of a stave/brick construction for modification according to the present disclosure.

FIG. 2 illustrates a preferred embodiment of a refractory brick 18 according to a preferred embodiment of a stave/brick construction 28 of the present disclosure. Brick 18 has an exposed face 26 and oblique or slanted top and bottom sections 19 and 20, respectively. Brick 18 also comprises or defines a locking side 29 comprising concave groove 22, a generally arcuate nose 23, a generally arcuate seat 25, a generally arcuate concave section 24, a lower face 27 and a generally planar front face 31. Brick 18 also has a neck 21, the vertical thickness ("ab") of which is increased with respect to the vertical neck 15 of known bricks 14. Preferably, the length "ab" of vertical neck 21 is equal to or greater than about two (2) times the length "cd" of the depth of brick 18 that is disposed in stave channel 37 when the brick 18 is installed therein. The shapes, geometries and/or cross-sections of brick 18 and/or any part thereof, including, without limitation, one or more of exposed face 26, lower face 27, front face 31, oblique/slanted top section 19, oblique/slanted bottom section 20, groove 22, nose 23, seat 25, concave section 24 and front locking side 29 may be modified or take other forms such as being angular, rectilinear, polygonal, geared, toothed, symmetrical, asymmetrical or irregular instead the shapes of the preferred embodiments thereof as shown in the drawings hereof without departing from the scope of the disclosure hereof. The refractory bricks 18 of the present disclosure preferably may be constructed from many of the refractory materials currently available including, but not limited to, silicon carbide (such as Sicanit AL3 available from Saint-Gobain Ceramics), MgO—C(magnesia carbon), alumina, insulating fire brick (IFB), graphite refractory brick and carbon. In addition, bricks 18 may be constructed from alternating or different materials depending upon their location in a stave 30 or within the furnace. Also, as set forth above, the shape of bricks 18 may also be modified or altered to meet various stave and/or furnace spaces and/or geometries.

Preferred embodiments of a stave/refractory brick construction 28 of the present disclosure is shown in FIGS. 2-7 and 9, including a preferred embodiment of a stave 30 of the present disclosure. Stave 30 may comprise a plurality of pipes (not shown), such as the pipes 13 disposed inside the stave 10 as shown in FIG. 1, which may be attached to one or more external pipes that extend from the furnace shell side of the stave 30 and penetrate the metal shell of the furnace so that coolant, such as, for example, water at an elevated pressure is pumped through such pipes (not shown) in order to cool the stave 30 and any refractory bricks 18 disposed within stave channels 37 thereof when assembled and installed in a furnace. Preferably, the stave 30 is constructed of copper, cast iron or other metal of high thermal conductivity, while any pipes disposed with stave 30 are preferably made from steel.

Each stave 30 preferably may be curved about its horizontal axis and/or about its vertical axis to match the internal profile of the furnace or area in which they will be used. Each stave 30 preferably comprises a plurality of stave ribs 32 and a stave socle 33 to support stave 30 in a standing position which may be a fully upright 90 degrees as shown, or a tilted or slanted position (not shown). Each stave rib 32 preferably defines a generally arcuate top rib section 34 and a generally arcuate bottom rib section 35. Stave 30 preferably defines a plurality stave channels 37 between each successive pair of stave ribs 32. Preferably, each stave channel 37 is generally "C-shaped" or "U-shaped" and includes a generally planar stave channel wall 38, although stave channel wall 38 may also be curved or contoured along its vertical and/or horizontal axes, toothed, etc., to be complementary with the front face 31 of brick 18 if such front face 31 has a shape other than the planar shape depicted herein, which may depend upon the application. Each stave channel 37 also preferably includes a generally arcuate upper channel section 39 and a generally arcuate lower channel section 40, all as defined by stave 30 and a successive pair of stave ribs 32. The shapes, geometries and/or cross-sections of one or more of the stave ribs 32, top rib sections 34, bottom rib sections 35, stave channels 37, stave channel walls 38, upper channel sections 39 and lower channel sections 40, preferably may be modified or take other forms such as being contoured, angular, rectilinear, polygonal, geared, toothed, symmetrical, asymmetrical or irregular instead the shapes of the preferred embodiments thereof as shown in the drawings hereof without departing from the scope of the disclosure hereof.

Figure 5:
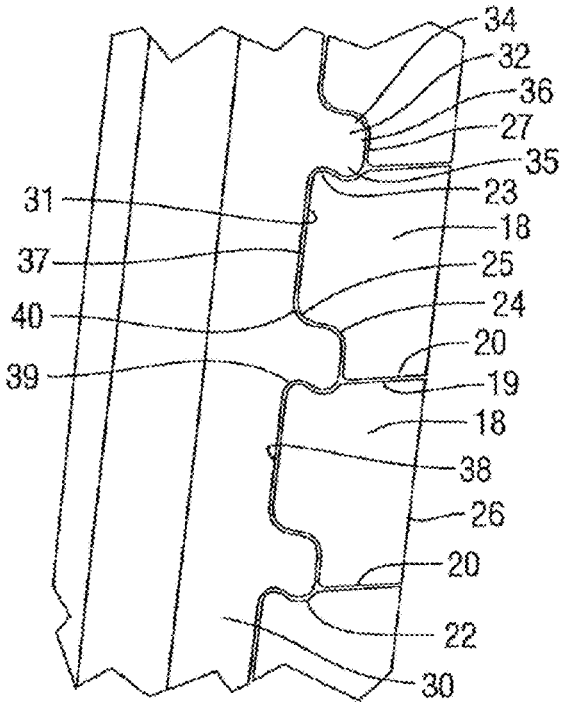
FIG. 5 is a cross-sectional view of a preferred embodiment of a stave/brick construction for modification according to the present disclosure.
Figure 6:
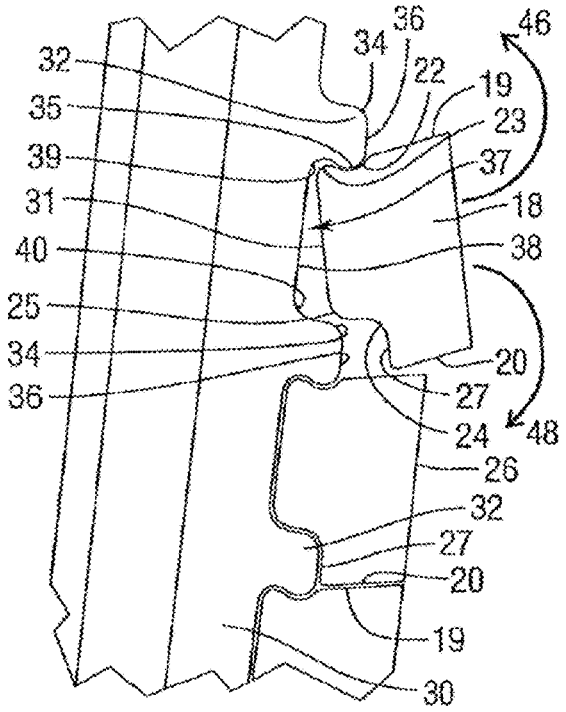
FIG. 6 is a cross-sectional view of a preferred embodiment of a stave/brick construction for modification according to the present disclosure.
Figure 7:
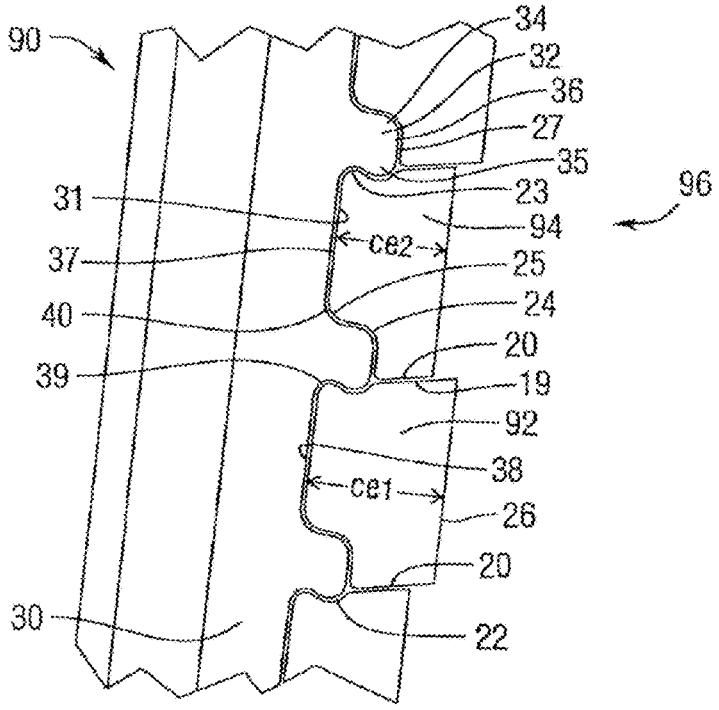
FIG. 7 is a cross-sectional view of a preferred embodiment of an alternative stave/brick construction for modification according to the present disclosure.

As shown in FIGS. 5 and 6, while the stave bricks 18 of the present disclosure may be slid into stave channels 37 from the sides 45 of stave 30 when space permits, stave bricks 18 may also preferably and advantageously be inserted into the front face 47 of staves 30. Beginning at the bottom of stave 30, each stave channel 37 may be filled with stave bricks 18 by rotating or tilting each brick 18 in a first direction 46 where the bottom portion of brick 18 moves away from stave 30 preferably (1) about an axis substantially parallel a plane of the stave or (2) to allow nose 23 to be inserted into stave channel 37 and into concave, arcuate upper channel section 39, after which brick 18 is rotated in a second direction 48 generally such that the bottom of brick 18 moves toward stave 30 until (i) nose 23 is disposed in-whole or in-part within concave, arcuate upper channel section 39 with or without the perimeter of nose 23 being in partial or complete contact with upper channel section 39, (ii) front face 31 of brick 18 is disposed substantially near and/or adjacent to channel wall 38 with or without the front face 31 being in partial or complete contact with channel wall 38, (iii) arcuate seat 25 is disposed in-whole or in-part within arcuate lower channel section 40 with or without the perimeter of seat 25 being in partial or complete contact with lower channel section 40, (iv) arcuate concave section 24 is disposed in-whole or in-part over the arcuate top rib section 34 of the lower stave rib 32 of the successive pair of stave ribs 32 defining the stave channel 37 into which the brick 18 is being inserted with or without the inside surface of concave section 24 being in partial or complete contact with the arcuate top rib section 34 of such lower stave rib 32, (v) lower face 27 of brick 18 is disposed substantially near and/or adjacent to rib face 36 with or without the lower face 27 being in partial or complete contact with rib face 36, and/or (vi) slanted bottom section 20 of the brick 18 being installed is disposed substantially near and/or adjacent to slanted top section 19 of the brick 18 immediately below the brick 18 being installed with or without such slanted bottom section 20 being in partial or complete contact with such slanted top section 19, in the case where the brick 18 is being installed in any of the stave channels 37 except the lowest stave channel 37 of stave 30. As illustrated in FIGS. 5-7, when the nose 23 is disposed in-whole or in-part within concave, arcuate upper channel section 39 with or without the perimeter of nose 23 being in partial or complete contact with concave, upper channel section 39, and/or arcuate seat 25 is disposed in-whole or in-part within concave, arcuate lower channel section 40 with or without the perimeter of seat 25 being in partial or complete contact with concave, lower channel section 40, each of the bricks 18 is prevented from being moved linearly out of stave channel 37 through the opening in the front face 47 of stave 30 without each brick 18 being rotated such that the bottom thereof is rotated away from the front face 47 of stave 30.

As also shown in FIGS. 4-7, once a row of bricks 18 is installed in a stave channel 37 above a row of previously installed bricks 18, the bricks 18 in such immediately lower row are locked into place and cannot be rotated in the first direction 46 away from stave 30 to be removed from stave channel 37. The stave/refractory brick construction 28 of the present disclosure as shown in FIGS. 2-6 and 9 may be employed with or without mortar between adjacent stave bricks 18.

FIG. 7 illustrates another preferred embodiment of a stave/brick construction 90 of the present disclosure which is the same as stave/brick construction 28 of FIGS. 3-6 except that it employs at least two different sizes of stave bricks 92 and 94, respectively, to form an uneven front face 96. As shown, bricks 92 of the stave/brick construction 90 have a greater overall depth "ce1" than the depth "ce2" of bricks 94. This staggered construction resulting from the different depths of stave bricks 92 and 94, respectively, may preferably be used in accretion zones or other desirable zones of the furnace where the uneven front face 96 would be more effective at holding an accretion or buildup of material to further protect the bricks 92 and 94 from thermal and/or mechanical damage.

Figure 8:
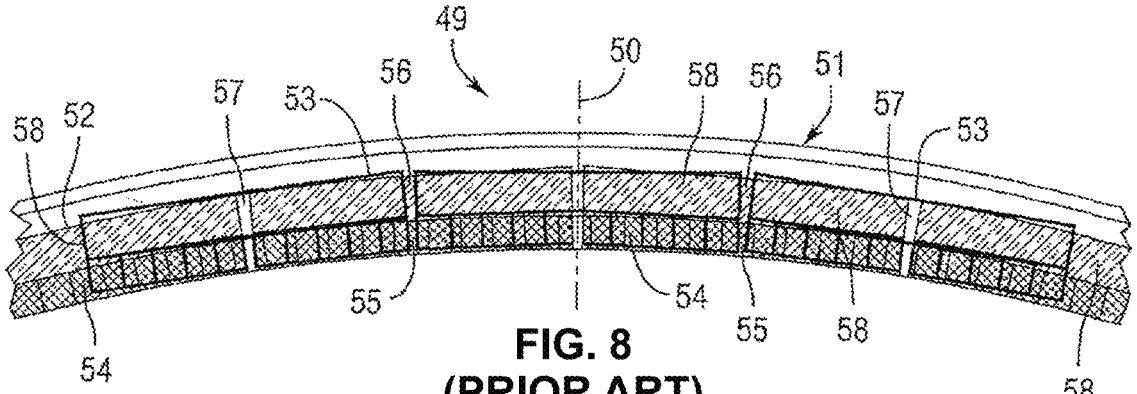
FIG. 8 (PRIOR ART)
FIG. 8 is a top plan view of a conventional furnace lining employing conventional stave/brick constructions.
Figure 9:
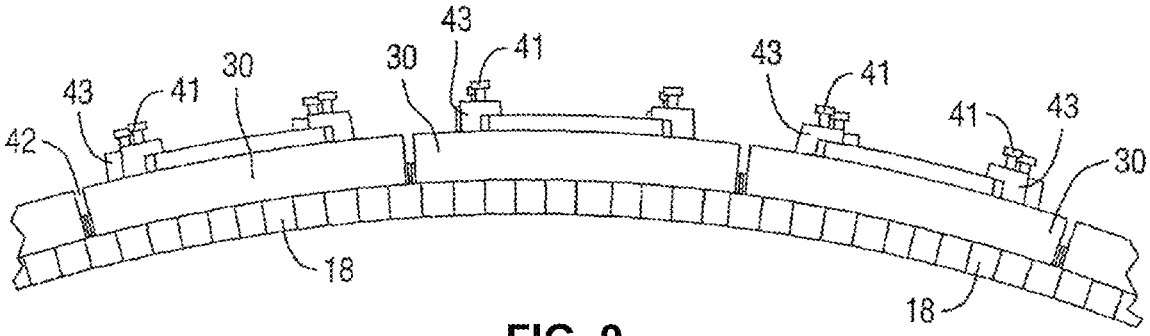
FIG. 9 is a top plan view of a preferred embodiment of a furnace lining comprising a preferred embodiment of a stave/brick construction for modification according to the present disclosure.

FIG. 8 illustrates the use of conventional stave/brick constructions 58 within a furnace 49. When using flat or curved staves/coolers, such as the flat/planar upper and lower staves 52 and 53, respectively, with pre-installed bricks 54 arranged within furnace shell 51, such staves 52 and 53 are installed in the furnace 49 such that ram gaps 56 exist in between adjacent pairs of upper staves 52 and such that ram gaps 57 exist in between adjacent pairs of lower staves 53, both to allow for construction allowance. These ram gaps 56 and 57 must be used to allow for construction deviation Such ram gaps 56 and 57 are typically rammed with refractory material (not shown) to close such gaps 56 and 57 between the adjacent stave/brick constructions 58. Such material filled gaps 56 and 57 typically are weak points in such conventional furnace linings using stave/brick constructions 58. During operation of furnace 49, the rammed gaps 56 and 57 erode prematurely and furnace gases track between the stave/brick constructions 58. With the preferably curved stave/brick constructions 28 of the present disclosure, the furnace can be bricked continuously around its circumference to eliminate conventional rammed gaps with bricks 18. As shown in FIG. 9, the gaps 42 between staves 30 are covered by one or more of bricks 18 of the present disclosure, eliminating the need for ramming filling material into such gaps 42. By eliminating the conventional rammed gaps 56 and 57 between the furnace bricks of adjacent staves 30, the integrity and life of the furnace and/or furnace lining is increased.

Another problem associated with the conventional stave/brick constructions 58 having pre-installed bricks 54, as shown in FIG. 8, is that because such conventional stave/brick constructions 58 are not continuously bricked around the circumference of furnace 49, edges 55 of numerous of the bricks 54 protrude into the interior of furnace 49 and are thus exposed to any matter falling through the furnace 49. Such protruding edges 55 tend to wear faster and/or are susceptible to being hit by falling matter, causing such bricks 54 with protruding edges 55 to break off into the furnace 49 and expose the staves 52 and 53. Again, the stave/brick constructions 28 of the present disclosure allow the furnace to be bricked continuously around its circumference thereby eliminating any such protruding brick edges 55, as shown in FIG. 9. Thus, the occurrences of (i) bricks 18 being pulled or knocked out of staves 30 and (ii) of staves 30 being directly exposed to the intense heat of the furnace are both significantly reduced by the stave/brick construction 28 of the present disclosure. Such characteristics make the stave/brick construction 28 of the present disclosure well-suited for use in the stack of blast furnaces.

As also shown in FIG. 9, a plurality of pin mounting cylinders 43 are preferably formed on the back side of each stave 30 for mounting pins 41 used to handle each stave 30, and/or to secure and/or mount each stave 30 within a furnace. Each of the pins 41 preferably defines a threaded or unthreaded thermocouple mounting hole (not shown) allowing one or more thermocouples to be easily installed at various locations on each stave 30.

While the preferred embodiment of a stave/refractory brick construction 28 of the present disclosure shown in FIGS. 2-7 and 9, includes a preferred embodiment of a furnace cooler or stave 30, the teachings of the present disclosure are also applicable to a frame/brick construction where such frame (not shown) is not limited to a furnace cooler or stave 30, but is a frame for providing a standing or other supported vertical or slanted wall of bricks, whether or not refractory bricks, for applications including, but not limited to, furnace applications.

Figure 10:
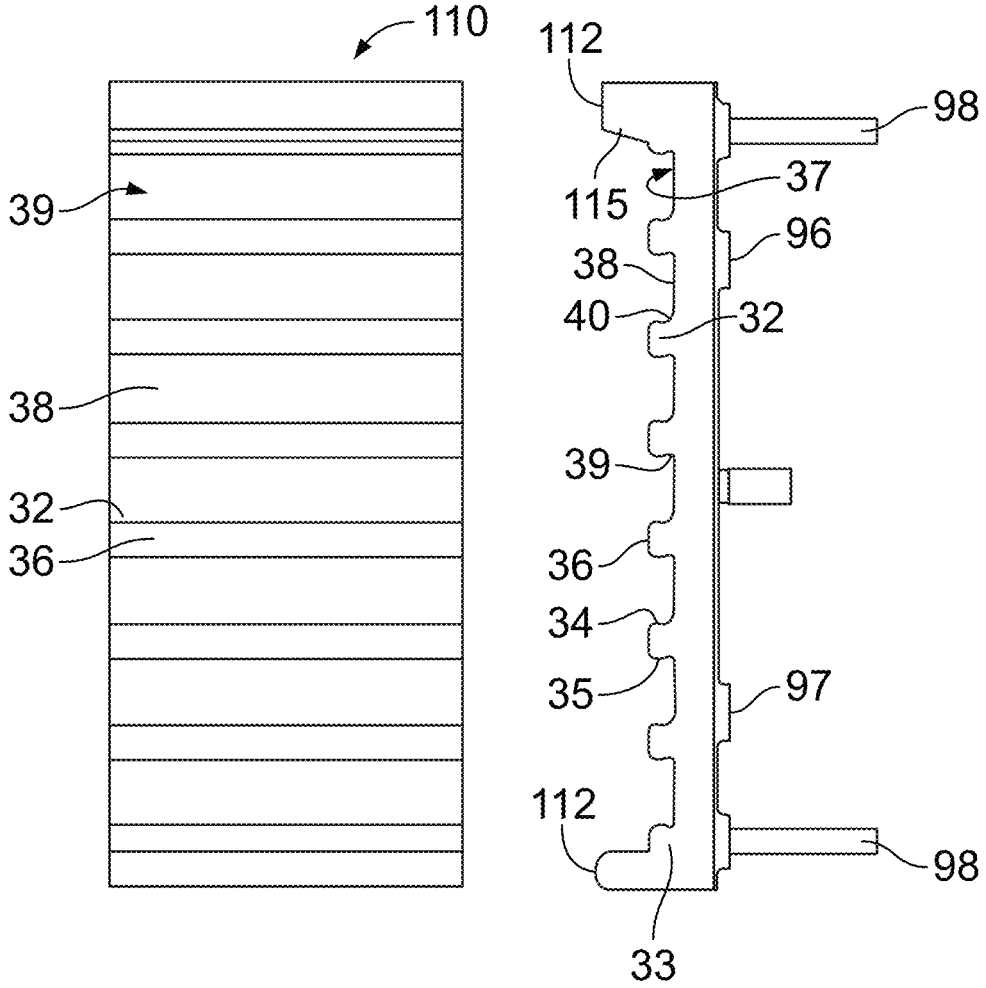
FIG. 10 shows a front elevational view and a cross-sectional view of a preferred embodiment of a stave according to the present disclosure.

FIG. 10 shows a preferred embodiment of a furnace cooling stave 110 of the present disclosure having one or more noses or protrusions 112. Each protrusion 112 preferably has an associated cooling-fluid inlet/outlet pipe 98 as part of its independent cooling-fluid circuit 120 Also, each stave 110 preferably has an associated cooling-fluid inlet pipe 96 and outlet pipe 97 as part of its main and independent cooling-fluid circuit 119. Protrusions 112 preferably may be disposed at the top, bottom or anywhere in between the top and bottom of stave 110. Stave 110 is preferably made from copper or other high heat conductivity material. Preferably, protrusions 112 have independent cooling circuits 120 (FIGS. 15 and 17) separate from the main stave body cooling circuit 119. With its independent cooling circuit 120, the nose 112 acts like a cooling plate and provides a cool surface to start an accretion forming thereon and provides structural support therefore. Preferably, independent cooling circuit 120 of nose 112 is designed to cool nose or protrusion 112 to the extent necessary to form a gummy (i.e., sticky, tacky, gluey, adhesive, resinous, or viscous) slag accretion on a surface of the nose or protrusion 112 and not to over cool the same such that the accretion is brittle and susceptible to breaking off of the nose or protrusion 112. The upper shelf created by nose 112 also shields and protects the refractory bricks 117 and 118 within the stave 110 from falling debris within the furnace.

Preferably, the bricks 117 and 118 installed in the stave 110 of the present disclosure as shown in FIGS. 11-13, 15 and 17 are of different thicknesses (front to back) to create a staggered brick face 121 which provides a variable thermal profile to provide cool pockets at and near shallow bricks 117 to support the formation of accretions 123 without gas channeling. An accretion layer 123 of slag forms over the staggered brick face 121 during operation of the furnace. Such an accretion layer 123 of slag is important to promote and retain throughout the furnace's campaign life because it provides an important first layer of heat insulation.

Figure 12:
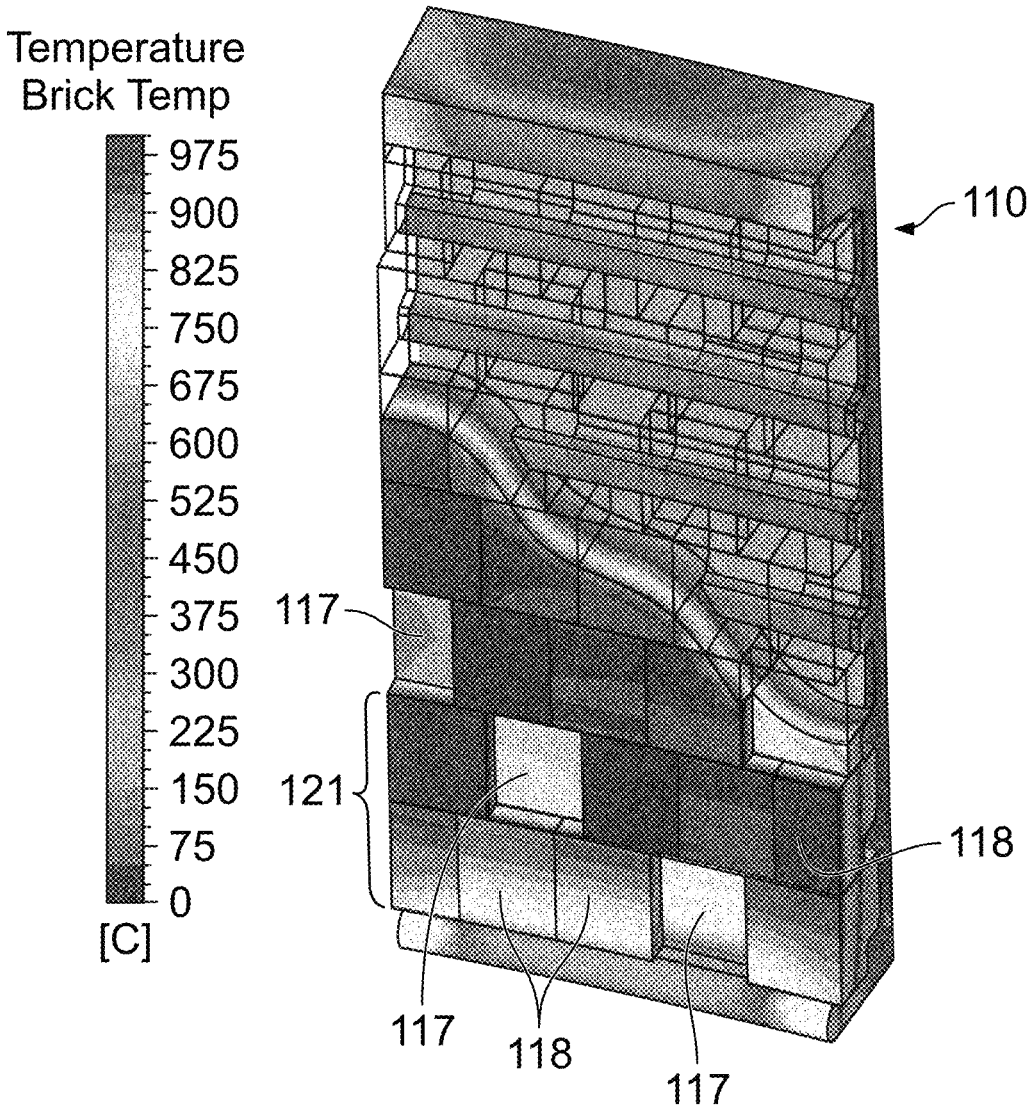
FIG. 12 shows a front perspective view of a preferred embodiment of a stave and brick construction having a face with a variable thermal profile according to the present disclosure.

FIG. 12 shows a preferred thermal profile on a preferred staggered brick face 121 of stave and brick construction 110 of the present disclosure showing cooler pockets at and near reduced thickness bricks 117 for slag accretion build up and warmer surface at the full brick surfaces 118.

Figure 13:
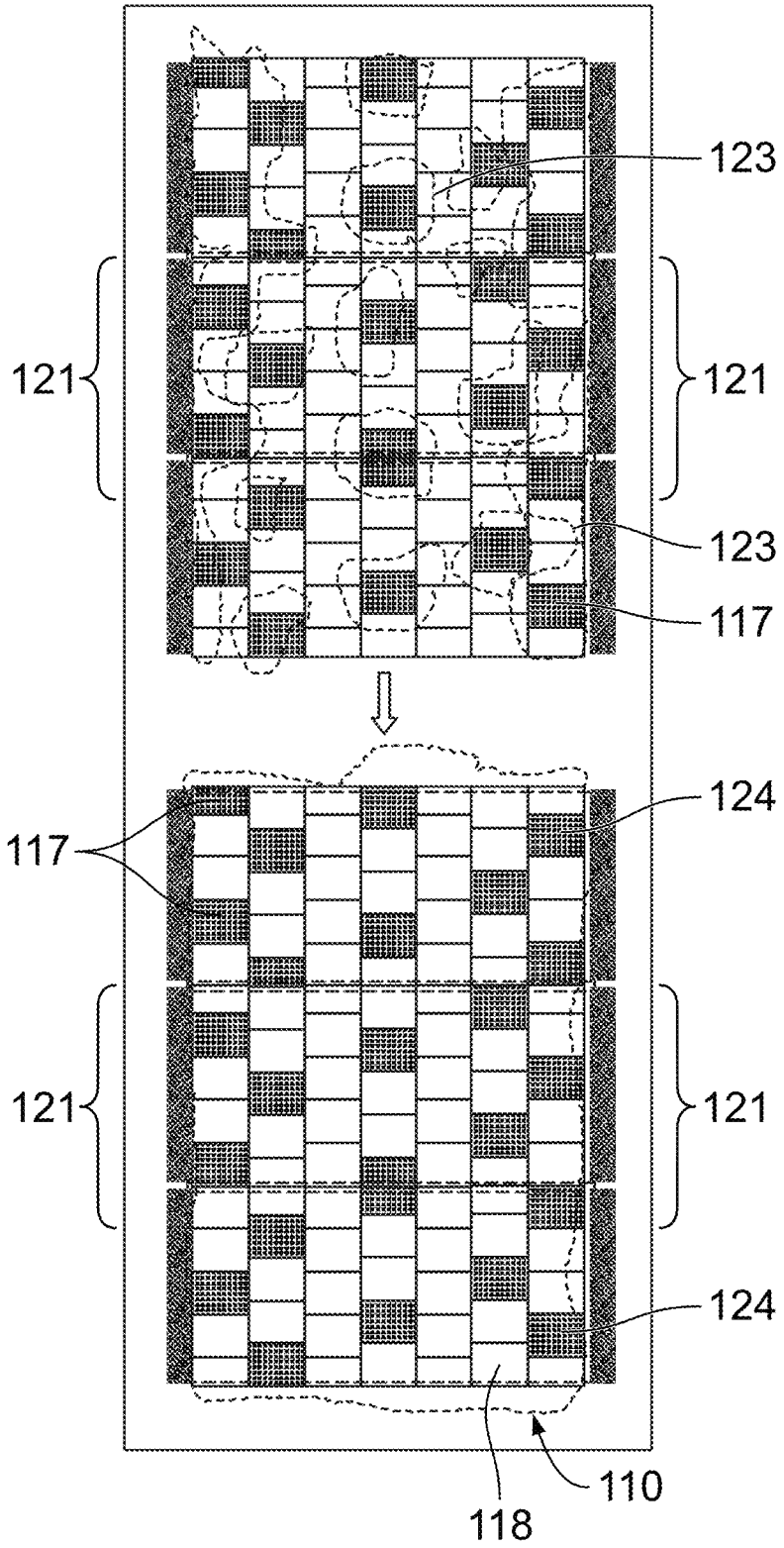
FIG. 13 show schematic views of a preferred embodiment of a stave and brick construction according to the present disclosure.

FIG. 13 shows that the accretions 123 preferably start to form in the cool step brick pockets 117 and as the accretions 123 grow they are supported by the staggered brick face 121 and attached to the warmer full depth brick faces 118. Such warmer surfaces 118 also help prevent the accretion 123 from becoming too brittle and cracking off, thereby allowing it to form a large accretion 124 over the staggered brick face 121.

Figure 14:
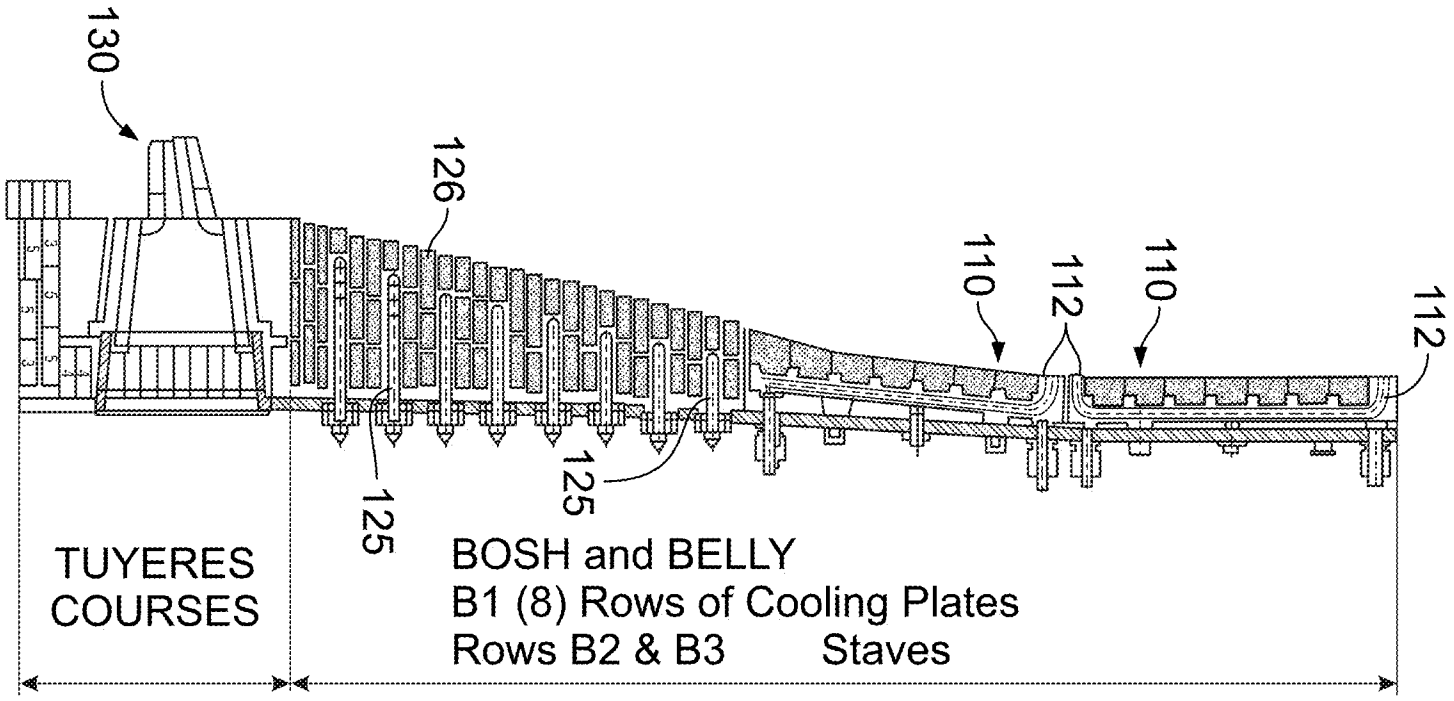
FIG. 14 shows a side view of a preferred furnace wall cooling construction comprising a preferred embodiment of a stave and brick construction according to the present disclosure.

FIG. 14 shows a system of the present disclosure comprising two rows of stave/brick constructions 110 according to the present disclosure having an independently-cooled noses 112 at the top of the system and plate coolers 125 inserted below the staves 110 and surrounded by refractory brick 126 wherein the bottom two cooling plates 125 have been extended to protect the tuyere surround 130. Preferably, the staves 110 in this preferred cooling arrangement of FIG. 14 are the same height & width as other existing staves (not shown) and therefore can use existing cooling fluid inlet/outlet piping and installation pins and bolting locations of the furnace. Here again, the independent circuit cooling circuits 120 of the noses 112 (preferably copper) of staves 110 are designed to not over cool the noses 112 so that the slag accretion formed is gummy or viscous enough and not completely cool such that it becomes brittle and breaks off.

Figure 15:
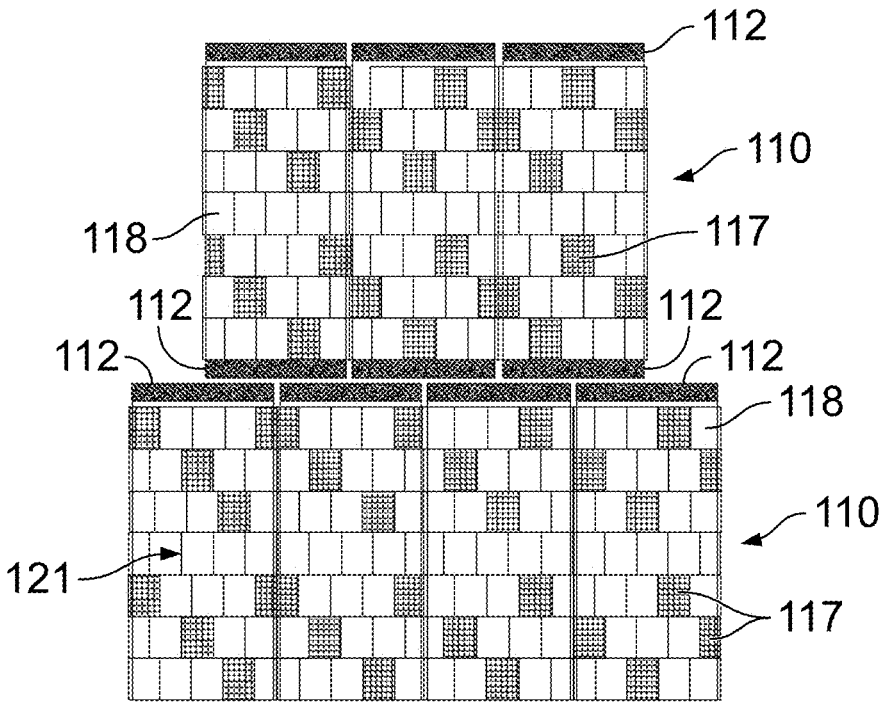
FIG. 15 shows a front elevational view of another preferred furnace wall cooling construction comprising a preferred embodiment of a stave and brick construction of the present disclosure and schematic views of preferred internal cooling fluid circuits therefor according to the present disclosure.
Figure 15:
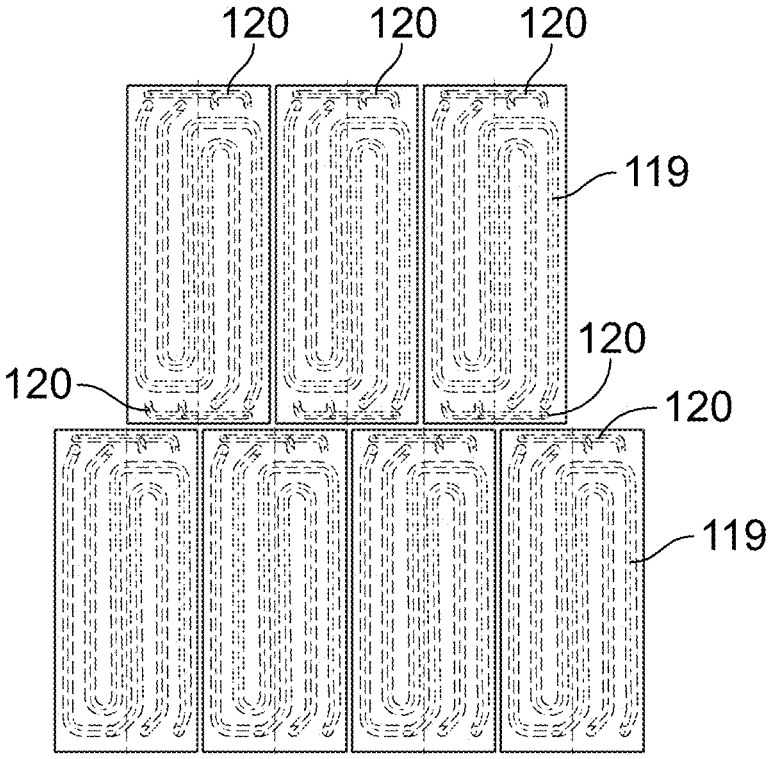

FIG. 15 shows the staggered brick faces 121 of the two rows of staves 110 from FIG. 14 and also the cooling circuits 119 for such staves 110, as well as showing the independent cooling circuits 120 for each of the noses 112 of each of the staves 110 in such system.

Figure 16:
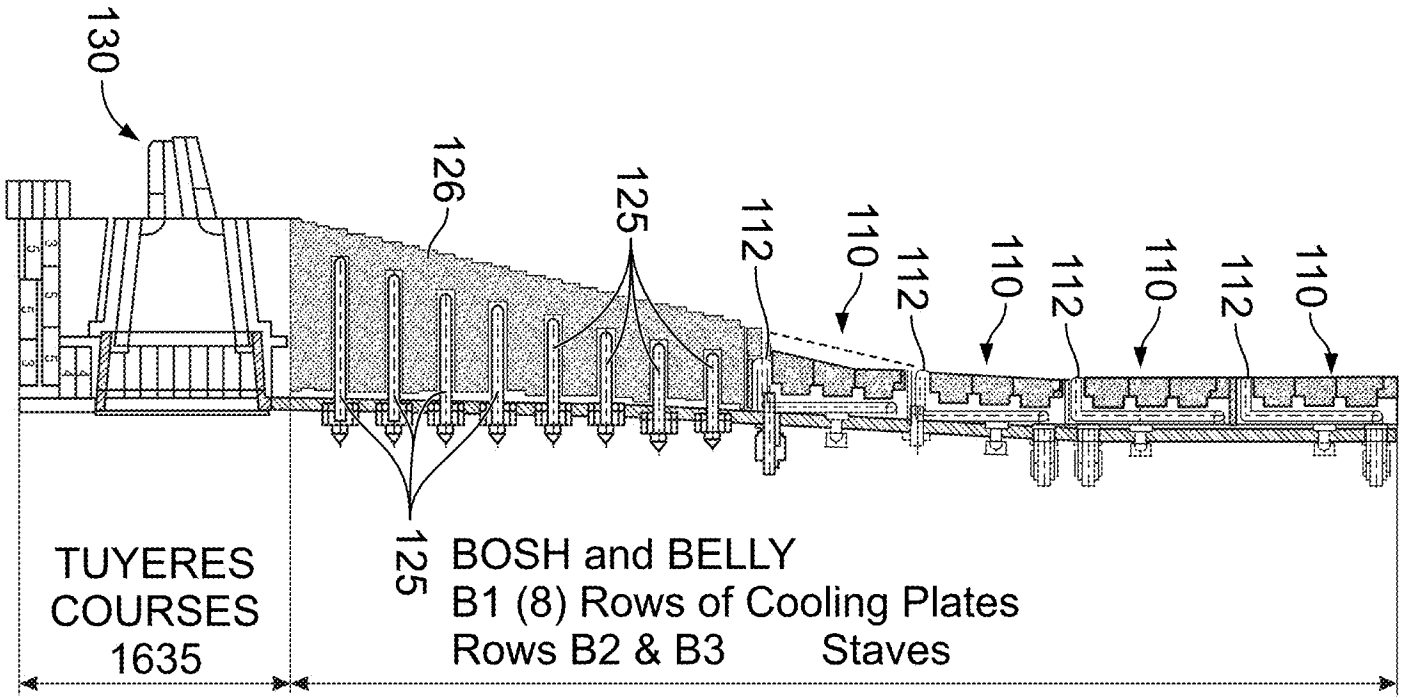
FIG. 16 shows a side view of yet another furnace wall cooling construction comprising a preferred embodiment of a stave and brick construction according to the present disclosure.

FIG. 16 shows another preferred embodiment of a furnace cooling arrangement present disclosure having four rows of stave/brick constructions 110, each preferably of half the height and 1.5 times the width of other existing staves used in the furnace. Preferably, such staves 110 can use existing cooling fluid inlet/outlet piping, but may require new or additional installation pins and bolting locations on the furnace. Preferably, each of the noses 112 in these staves 110 is located at the bottom of each stave 110 and is designed to not over cool so that slag accretions can form and not become brittle and break off. Here again, plate coolers 125 are preferably inserted below the staves 110 and surrounded by refractory brick 126 wherein the bottom two cooling plates 125 have been extended to protect the tuyere surround 130.

Figure 17:
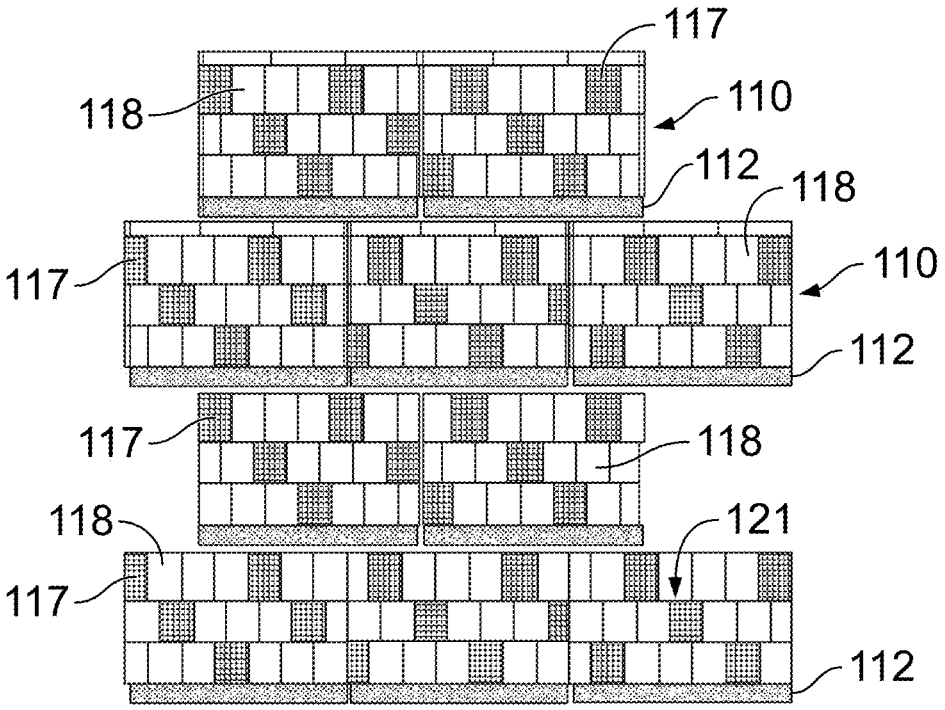
FIG. 17 shows a front elevational view of a further preferred furnace wall cooling construction comprising a preferred embodiment of a stave and brick construction of the present disclosure and schematic views of preferred internal cooling fluid circuits therefor according to the present disclosure.
Figure 17:
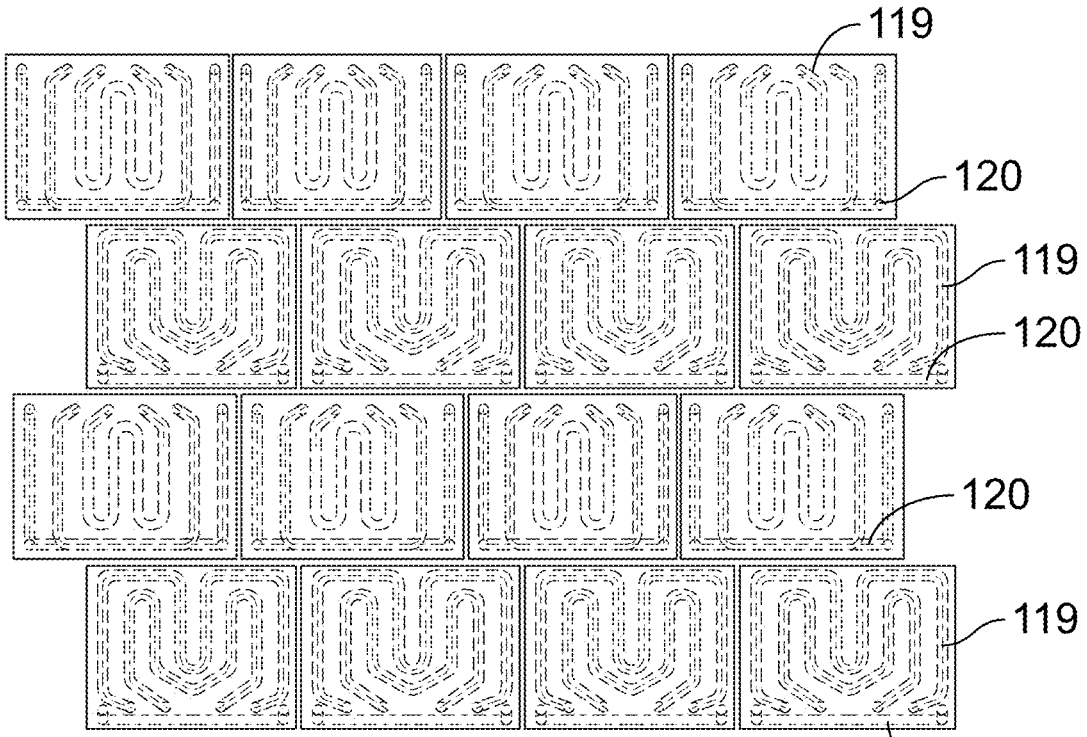

FIG. 17 shows the staggered brick faces 121 of the four rows of staves 110 from FIG. 16 and also the cooling circuits 119 for such staves 110, as well as showing the independent cooling circuits 120 for each of the noses 112 of each of the staves 110 in such arrangement as shown, the nose 112 of each stave 110 is preferably located on the bottom of each stave 110 in this arrangement of FIGS. 16-17.

Figure 11:
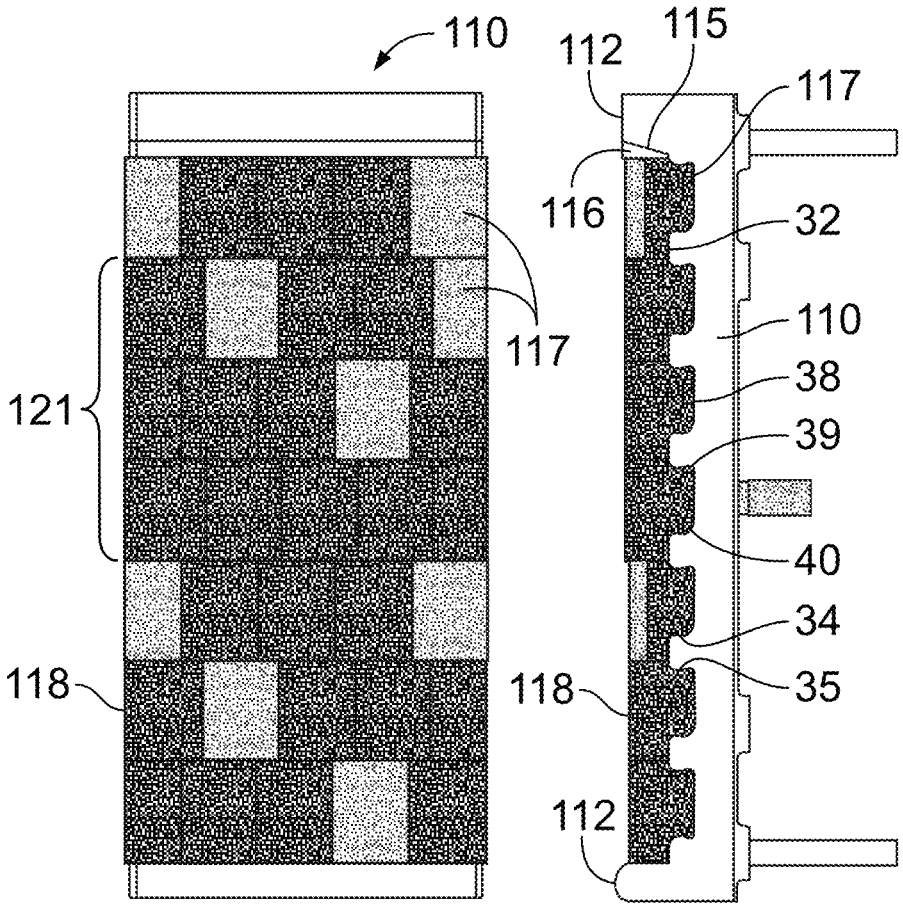
FIG. 11 shows a front elevational view and a cross-sectional view of a preferred embodiment of a stave and brick construction according to the present disclosure.

Preferably, when the nose or protrusion 112 is disposed at the top of the stave 110, it defines a slanted under surface 115 (as shown in FIGS. 10-11) to provide a gap 116 for refractory bricks 117 and 118 to be rotated in and out of the stave 110 as described herein above and as is known in the art as per U.S. Pat. No. 9,102,990 incorporated herein for all purposes. Also, each stave 110 may have one or more noses 112 located at the top, bottom or some location therebetween on the stave 110 as needed or desired. All such protrusions or noses 112 may or may not be independently fluid-cooled, as needed, in accordance with the present disclosure.

Preferably, any of the stave/brick constructions 110 of the present disclosure also may be assembled initially by setting the bricks 117 and/or 118 in a form and casting the stave 110 around the bricks 117 and/or 118.

In the foregoing Detailed Description, various features are grouped together in a single embodiment to streamline the disclosure. This method of disclosure is not to be interpreted as reflecting an intention that the claimed embodiments of the disclosure require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A furnace stave comprising:

a main stave body comprising a front face having stave channels, wherein the stave channels have stave channel walls, the stave channels being configured to receive a plurality of refractory bricks that extend away from the stave channel walls;

a plurality of internal channels or conduits for circulating cooling fluid through the stave;

an inlet and an outlet channel associated with each internal channel or conduit;

wherein one of the internal channels or conduits is disposed in a protrusion from the stave;

wherein the protrusion is located at a top of the stave and further comprises an outermost surface that is coplanar with the stave channel walls and opposite from at least one of the inlet channel or the outlet channel;

wherein the cooling fluid circulating through the internal channel or conduit disposed in the protrusion is configured to cool such protrusion to an extent necessary to form a gummy slag accretion on a surface of the protrusion and not to over cool the same such that the accretion is brittle and susceptible to breaking off of the protrusion; and wherein when the stave channels receive the refractory bricks, the protrusion; extends away from the stave channel walls at least as far as the refractory bricks.

2. The stave of claim 1 wherein the protrusion is a first protrusion and the stave further comprising at least a second protrusion located at a bottom and/or a location in between the top and the bottom of the stave.

3. The stave of claim 2, wherein each protrusion has its own internal cooling conduit or circuit.

4. The stave of claim 2 further comprising refractory bricks of at least two different thicknesses disposed within the stave to define a front face comprising one or more depressions.

5. The stave of claim 3 further comprising refractory bricks of at least two different thicknesses disposed within the stave to define a front face comprising one or more depressions.

6. The stave of claim 1, wherein the protrusion comprises a slanted under surface to provide a gap for refractory bricks to be rotated in and out of the stave.

7. The stave of claim 1 further comprising a plurality of refractory bricks having a first thickness and a plurality of refractory bricks having a second thickness disposed within the stave to define the front face comprising one or more depressions, wherein at least one of the refractory bricks having the first thickness and at least one of the refractory bricks having the second thickness are not in contact with the protrusion.

* * * * *